United States Patent [19]

Mehra

[11] Patent Number: 4,858,776

[45] Date of Patent: Aug. 22, 1989

[54] BOTTLE CLOSURE ASSEMBLY

[75] Inventor: Ravinder C. Mehra, Fairport, N.Y.

[73] Assignee: Nalge Company, Rochester, N.Y.

[21] Appl. No.: 266,527

[22] Filed: Nov. 3, 1988

[51] Int. Cl.[4] ..... B65D 53/04

[52] U.S. Cl. ..... 215/270; 215/341

[58] Field of Search ..... 215/270, 342, 341, 344, 215/329

[56] References Cited

U.S. PATENT DOCUMENTS 4,640,428 2/1987 Chang ..... 215/270

FOREIGN PATENT DOCUMENTS 588244 12/1959 Canada ..... 215/341

*Primary Examiner*—Donald F. Norton

*Attorney, Agent, or Firm*—Marjama & Pincelli

[57] ABSTRACT

A plastic bottle closure assembly comprising a plastic bottle having a threaded neck portion, a closure for engagement with the neck portion and a sealing plug. The sealing plug has an annular mating surface designed to engage an annular planer mating surface of the neck portion. The closure is provided with annular rib for engaging the plug so as to cause the inner mating surface of the plug to engage the mating section of neck portion of the bottle.

7 Claims, 4 Drawing Sheets

BOTTLE CLOSURE ASSEMBLY

The present invention relates to closure assemblies for plastic bottles requiring secure seals.

BACKGROUND OF THE INVENTION

In certain fields, such as in the laboratory and research fields, it is often necessary to purchase and use chemicals that are extremely expensive which may also be highly corrosive and/or toxic. Typically, such chemicals are purchased in plastic bottles having a typical threaded closure system. With such chemicals, it is important to avoid or minimize the amount of leakage of liquid and/or vapor from the bottle, particularly during shipment and storage. In order to provide a better seal in the bottle, the prior art has typically placed a sealing gasket within the closure which mates with the top of the rim of the neck portion on which it is placed. While such gaskets do improve sealing to a certain extent, it does not work effectively in certain situations. For example, during shipping and storage of liquid filled bottles, the temperature of the liquid within the bottle can increase such that the pressure therein causes the closure to deform allowing vapors and/or liquid to escape over time. It has also been suggested in the prior art the use of a rigid plug which fits within the neck portion of the container and has a sealing lip located between the top of the rim and the closure. This plug functions much as a gasket or washer would. However, this structure has not been effective in reducing the escape of vapors and/or liquid to acceptable levels. Such prior art closure assemblies rely mainly on the seal between the top of the rim and the cap. As such, cannot compensate effectively in response to temperature changes and still maintain an effective sealing engagement between the closure and neck portion of the bottle.

There has also been suggested in the prior art the use of a cap wherein a sealing rib engages a beveled portion on the inside surface of the rim of a bottle. While this does provide improved sealing capabilities between the closure and bottle, this arrangement still does not provide adequate sealing to prevent vapors and/or liquids from escaping under extreme environmental conditions.

Applicant has invented a bottle closure assembly which provides a high degree of sealing which minimizes or prevents the escape of small amounts of vapor and/or liquid from the bottle during extreme environmental changes that may be experienced.

SUMMARY OF THE INVENTION

In accordance with the present invention, there is provided a bottle closure assembly which comprises a plastic bottle having a neck portion that includes an externally threaded portion and an outer rim portion which defines an outlet of the bottle. The inside surface of the rim is provided with an annular planar mating surface disposed at a first angle with respect to the longitudinal axis of the bottle. The closure assembly further comprises a thin, flexible sealing plug which comprises an outer lip for engagement with the top surface of the rim, an annular mating section adjacent the radial inner side of the lip, and a well for placement within the neck portion of the bottle. The annular mating section has an inner mating surface for engagement with the annular planar mating surface of the rim, and an outer surface. A closure is provided for placement over the sealing plug and engagement with the external threaded portion of the bottle. The closure comprises a top wall, a circular outer side wall extending downward from the top wall, and an annular sealing rib on its lower surface spaced radially from the side wall. The rib has a generally arcuate mating surface for engagement with the outer mating surface of the annular mating section of the flexible plug so as to cause the inner mating surface of the annular mating section of the sealing plug to engage the annular sealing surface of the bottle.

DETAILED DESCRIPTION OF THE INVENTION

Figure 1:
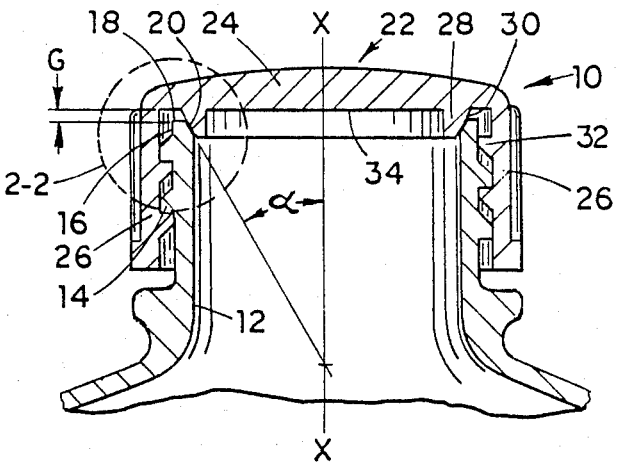
FIG. 1 PRIOR ART
FIG. 1 illustrates a enlarged cross-sectional view of a closure and bottle in accordance with the prior art.
Figure 2:
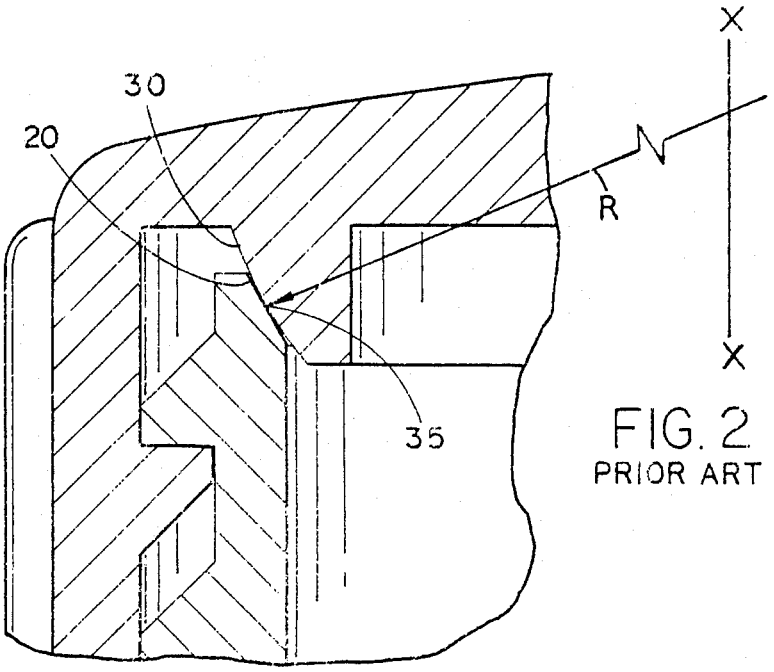
FIG. 2 PRIOR ART
FIG. 2 is a further enlarged partial cross-sectional view of the circled portion in FIG. 1 identified as 2—2.

Referring to FIGS. 1 and 2, there is illustrated a bottle closure assembly 10 made in accordance with the prior art. The bottle closure assembly 10 comprises a plastic bottle having a rigid neck portion 12. In the particular embodiment illustrated, the bottle is made of Flourinated ethylene propolyene, however, the bottle may be made of any desired plastic. The neck portion 12 includes an externally threaded portion 14 and defines an outlet of the bottle. The neck portion 12 further includes an outer rim 16 having a top surface 18 and an annular planar mating surface 20. The annular planar mating surface 20 is disposed at an angle $\alpha$ with respect to the longitudinal axis x—x of the bottle. The closure assembly 10 further includes a rigid plastic closure 22 having a top wall 24, and a circular outer side wall 26 extending downward from the top wall 24. The closure 22 further includes an annular sealing rib 28 having a generally arcuate mating surface 30 for engagement with the annular planar mating surface 20. In the particular embodiment illustrated, closure 22 is made of ethylenetetrafluoroethylene, however, closure 22 may be made of any other hard plastic so desired. As is illustrated, the closure 22 is secured to neck portion 12 by internal threads 32 which engage the external threads 14. As the closure 22 is tightened into sealing relationship, the arcuate mating surface 30 engages the planar mating surface 20. Since sealing is effectuated between these two surfaces, a small gap g is provided between the top surface 18 and the bottom surface 34 of top wall 24.

The arcuate mating surface 30 is designed to have a curvature such that the area of sealing between the arcuate mating surface 30 and annular mating surface 20 is approximately midway along the planar mating surface 20. Preferably, the arcuate mating surface 30 is designed such that it has a radius R which is tangent to the mid point 35 of surface 20 and equal to the distance between the tangency point and the longitudinal axis x—x as indicated by the radius R. However, it is to be understood that any other desired curvature may be selected for mating surface 30 so as to provide the appropriate sealing engagement therebetween.

While a closure assembly such as illustrated in FIG. 1 generally provides a relatively tight seal, it has not been found effective to reduce leakage of vapor and/or liquid under extreme conditions.

A problem experienced with such prior art device is that when a pressure is experienced internally of the bottle, this causes the cap 22 to bow upward, thus causing the sealing rib 28 to move toward the longitudinal axis x—x thereby reducing the sealing engagement pressure between the closure 22 and neck portion 12.

Figure 3:
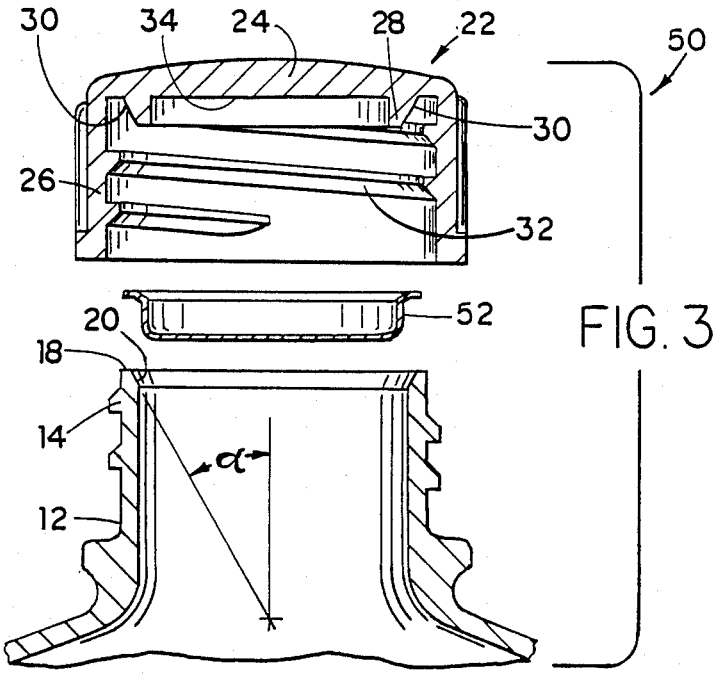
FIG. 3 is an enlarged cross-sectional exploded view of a closure assembly made in accordance with the present invention.

Referring to FIG. 3, there is illustrated a closure assembly 50 made in accordance with the present invention. Closure assembly 50 is similar to closure assembly 10 illustrated in FIGS. 1 and 2, like numerals indicating like parts, except that a thin, flexible compliant sealing plug 52 is provided for placement between the rim 16 and bottom surface 34 of closure 12. The sealing plug 52 is preferably made of a flexible plastic, and in the embodiment illustrated, plug 22 is made of flourinated ethylene propolyene and is vacuum formed. It is of course understood that plug 52 may be made of any other suitable plastic so desired.

Figure 4:
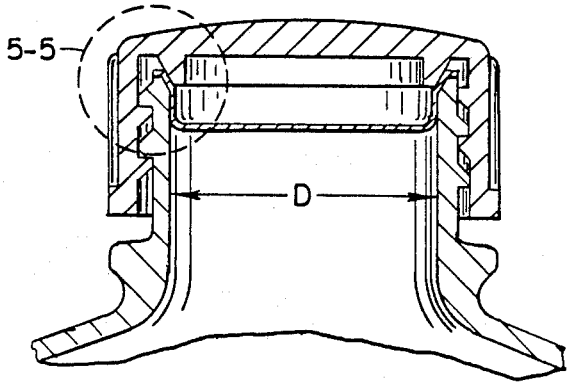
FIG. 4 is an enlarged cross-sectional view of the closure assembly in accordance with the present invention as assembled.
Figure 5:
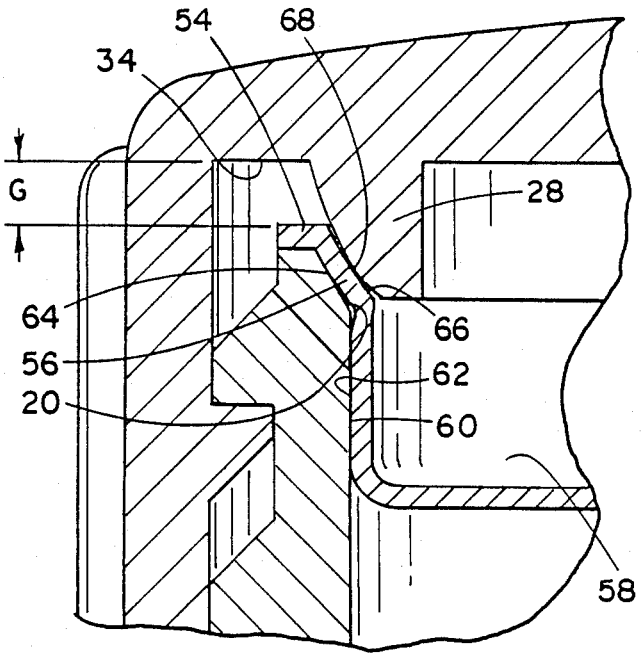
FIG. 5 is a further enlarged partial cross-sectional view of the circled portion in FIG. 4, identified as 5—5.
Figure 6:
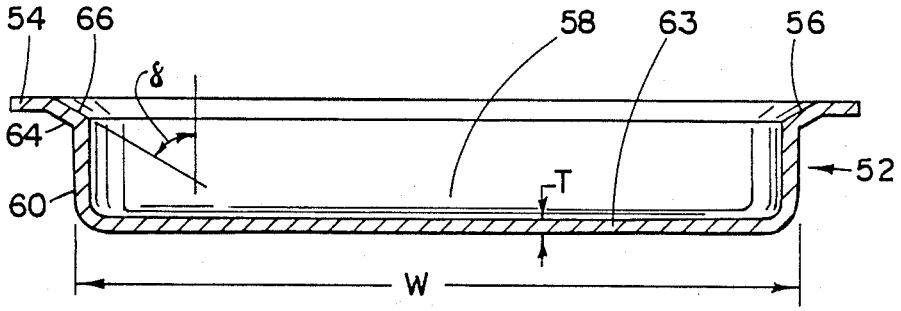
FIG. 6 is a greatly enlarged cross sectional view of the sealing plug of FIG. 2 in the unflexed state.
Figure 7:
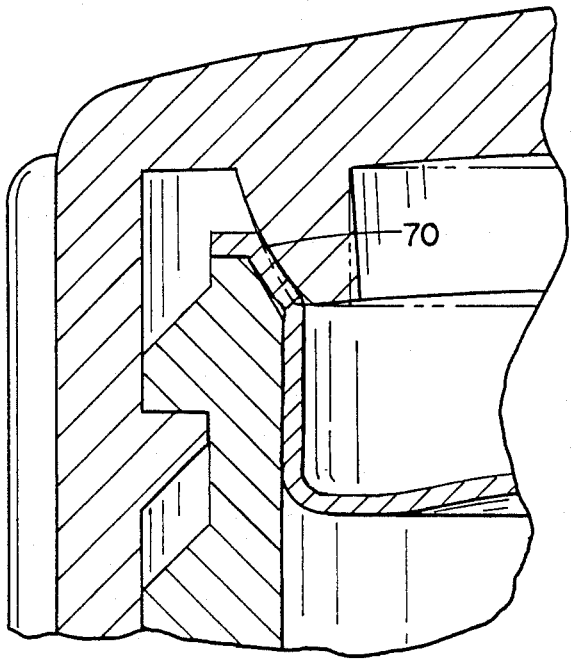
FIG. 7 is a view similar to FIG. 5 illustrating the position of the cap when an internal pressure is being experienced.

Referring to FIGS. 4, 5 and 6, sealing plug 52 comprises an annular lip 54 and an annular mating section 56 extending radially inward from the inner surface of the lip 54 terminating in a generally cylindrical shape well portion 58 having a substantially cylindrical outer surface 60 for placement adjacent the inside surface 62 of neck portion 12 and a bottom wall 63. The annular mating section 56 comprises an inner mating surface 64 for mating with the planar mating surface 20 of neck portion 12 and outer mating surface 66 which is substantially parallel to the inner surface 64 and is designed to engage the arcuate mating surface 30 of sealing rib 28. As can be clearly seen in FIG. 5, the sealing engagement is provided by the sealing rib 28, annular mating section 56 of plug 52 and annular surface 20. This engagement provides a gap G between the lip 54 and bottom surface 34 of closure 22. In the unflex state, as illustrated in FIG. 5, the inner surface 64 and outer surface 66 of sealing plug 52 are disposed at an angle $\gamma$ with respect to the longitudinal axis x—x of the bottle. Angle $\gamma$is selected so as to be greater than the angle $\alpha$ of mating surface 20 of neck portion 12. Preferably, angle $\gamma$ is greater than angle $\alpha$ by at least 10°. In the particular embodiment illustrated, angle $\gamma$ is about 60° and angle $\alpha$ is about 30°. The plug 52 is made of a thin, flexible material such that the annular mating section 64 acts like a spring so as to conform to the pressure that is exerted between the sealing rib 28 and rim 16. In the embodiment illustrated, the sealing plug 52 has a thickness T in the range of 0.005 to 0.020 inches, preferably in the range of 0.008 to 0.016 inches. Applicants have found that a thickness T in the range of 0.010 to 0.015 inches to be most effective. In the particular embodiment illustrated, the cross sectional thickness T is about 0.015 inches. As illustrated in FIG. 4, when substantially no internal pressure is being experienced by the bottle, the sealing rib 56 is substantially tangent to the outer mating surface 66 at point 68 and the inner mating surface 64. Well portion 58 has a width W which is preferably slightly greater than the internal cross sectional diameter D of the inside surface 62 of neck portion 12 so as to provide a small interference fit. In the embodiment illustrated, well portion 58 has a width W of about 0.820 inches and neck portion 12 has a diameter D of about 0.850 inches. Referring to FIG. 6, the closure 22 is illustrated in the position it would take when an internal pressure is being experienced. The broken lines indicate the position of closure 22 without any substantial internal pressure. In this situation, the sealing area between the arcuate mating surface 30 with respect to the outer mating surface 66 occurs at point 70 which is above point 68. This is because pressure within the bottle causes the closure to slightly bow up as illustrated in FIG. 7. Since the plug 52 is a thin, compliant flexible member, it will move upward radially along the arcuate mating surface 30 as indicated, thus, continuing to provide a tight seal therebetween. The plug functions much as a spring to adjust to the movement of the sealing rib.

Bottles having a closure assembly 50 made in accordance with the present invention was compared with bottles having a closure assembly 10 made in accordance with the prior art for sealing effectiveness. The test consisted of filling the bottles with water having blue food coloring. These bottles were placed in a vacuum chamber and subjected to a vacuum for a 15 minute time period. White paper towel was placed under the bottles to assist in detecting leaks. About 90 bottles having a bottle assembly 10, i.e., without a sealing plug, were subjected to a vacuum of 20 inches of mercury for 15 minutes. Approximately 19 bottles failed to maintain a seal. These same bottles were tested again, except that a plug 52 made in accordance with the present invention was used to provide a closure assembly 50. The bottles were then subjected to a vacuum of 29 inches of mercury for 15 minutes. All of these assemblies passed in that no perceptible leak was found. Not only did the closure assembly 50 provide an improved sealing engagement, it did so at a higher vacuum.

It is to be understood that various changes and modifications can be made without departing from the scope of the present invention. The present invention being defined by the following claims.

What is claimed is:

1. A bottle closure assembly comprising:

a plastic bottle having a neck portion that includes an externally thread portion and an outer rim which defines an outlet of the bottle, the inside surface of the rim having an annular planar mating surface disposed at a first angle with respect to the longitudinal axis of the bottle;

a thin flexible sealing plug comprising an annular outer lip for engagement with the top surface of the rim, an annular mating section adjacent the inner side of said lip, and a generally cylindrical shape well portion for replacement adjacent the inside surface of said neck, said annular mating section having an inner and outer mating surfaces, said inner and outer surfaces being substantially parallel to each other and disposed at second angle with respect to the longitudinal axis of said bottle, said second angle of said annular mating surface of said plug being greater than said first angle of said sealing surface of said rim;

a closure for placement over said sealing plug and for engagement with the neck portion of said bottle, said closure comprising a top wall, a circular outer side wall extending downward from said top wall and an annular sealing rib on its lower surface and spaced radially from said side wall, said rib having a generally arcuate mating surface for engagement with said outer surface of said annular mating section of said flexible plug so as to cause the inner mating surface of said annular mating section of said sealing plug to engage said annular sealing surface of said bottle.

2. The bottle closure assembly according to claim 1 wherein said first angle of said sealing surface being disposed at an angle of approximately 30° and said second angle of said sealing plug being disposed at approximately 60°.

3. A bottle closure assembly according to claim 1 wherein said second angle of said sealing plug is greater than said first angle of said sealing surface of said bottle by at least 10°.

4. A bottle closure assembly according to claim 1 wherein said well has a cross-sectional width equal to or greater than the inside width of said neck so as to provide slight frictional fit.

5. A bottle closure according to claim 1 wherein said flexible sealing plug has a cross-sectional thickness in the range of 0.005 to 0.020 inches.

6. A bottle closure according to claim 1 wherein said flexible sealing plug has a cross-sectional thickness in the range of 0.008 to 0.016 inches.

7. A bottle closure according to claim 1 wherein said flexible sealing plug has a cross-sectional thickness in the range of 0.010 to 0.015 inches.

* * * * *